US008334023B2

(12) United States Patent
Gaon et al.

(10) Patent No.: US 8,334,023 B2
(45) Date of Patent: Dec. 18, 2012

(54) METHODS FOR REGULATING THE PLACEMENT OF FLUID DISPENSED FROM AN APPLICATOR ONTO A WORKPIECE

(75) Inventors: Martin Gaon, Merrick, NY (US); Steven Julian, Canton, GA (US)

(73) Assignee: Nordson Corporation, Westlake, OH (US)

( * ) Notice: Subject to any disclaimer, the term of this patent is extended or adjusted under 35 U.S.C. 154(b) by 400 days.

(21) Appl. No.: 12/256,052

(22) Filed: Oct. 22, 2008

(65) Prior Publication Data

US 2009/0038707 A1 Feb. 12, 2009

Related U.S. Application Data

(62) Division of application No. 11/103,282, filed on Apr. 11, 2005, now Pat. No. 7,462,377.

(60) Provisional application No. 60/567,375, filed on Apr. 30, 2004.

(51) Int. Cl.
*B65B 1/04* (2006.01)

(52) U.S. Cl. ..... 427/427.2; 141/1; 427/207.1

(58) Field of Classification Search ..... 427/427.2, 427/207.1; 141/1

See application file for complete search history.

(56) References Cited

U.S. PATENT DOCUMENTS

| | | | | |
|---|---|---|---|---|
| 4,957,782 | A | 9/1990 | Medler et al. | |
| 5,026,989 | A | 6/1991 | Merkel | |
| 5,479,352 | A * | 12/1995 | Smith | 700/95 |
| 5,540,946 | A | 7/1996 | DeVries et al. | |
| 5,683,752 | A | 11/1997 | Popp et al. | |
| 6,299,931 | B1 * | 10/2001 | Leary et al. | 427/8 |
| 6,770,142 | B2 | 8/2004 | Estelle | |

FOREIGN PATENT DOCUMENTS

| | | | |
|---|---|---|---|
| JP | 63-120045 | A | 5/1988 |
| JP | 03215026 | A | 9/1991 |
| JP | 2000126665 | A | 5/2000 |
| JP | 2001259499 | A | 9/2001 |

OTHER PUBLICATIONS

Japanese Patent Office, Office Action issued in related Japanese patent application serial No. 2005-130658 dated Dec. 27, 2010.

* cited by examiner

*Primary Examiner* — Timothy Meeks

*Assistant Examiner* — Nathan T Leong

(74) *Attorney, Agent, or Firm* — Wood, Herron & Evans, LLP

(57) ABSTRACT

Methods for operating a material dispensing system. The method includes measuring numerical values of an operating parameter, such as line velocity, material pressure, or material temperature, of the dispensing system to predict a future numerical value of the operating parameter. The predicted numerical value of the operating parameter is used to accurately define a start time, which is measured from the detection of the presence of a workpiece being transported past an applicator of the dispensing system, at which to initiate dispensing of the material from the applicator. A calibration procedure is provided for deriving a mathematical relationship used to determine the predicted numerical value of the operating parameter.

14 Claims, 4 Drawing Sheets

METHODS FOR REGULATING THE PLACEMENT OF FLUID DISPENSED FROM AN APPLICATOR ONTO A WORKPIECE

CROSS-REFERENCE TO RELATED APPLICATIONS

This application is a divisional of application Ser. No. 11/103,282, filed Apr. 11, 2005, which claims the benefit of U.S. Provisional Application No. 60/567,375 filed on Apr. 30, 2004. The disclosure of each application is hereby incorporated by reference herein in its entirety.

FIELD OF THE INVENTION

This invention relates generally to material applicators and, more particularly, to systems and methods for controlling the operation of an applicator to regulate the placement of a material, such as an adhesive, applied to a workpiece.

BACKGROUND OF THE INVENTION

Applicators are routinely employed in many diverse industrial applications to apply a pattern of a material, such as one or more beads of an adhesive, to each of a series of workpieces being sequentially transported on a conveyer past the applicator. In automated packaging production lines, for example, adhesive applicators apply one or more amounts or beads of hot melt thermoplastic adhesive to joint flaps of blanks that are subsequently folded to assemble adhesively-bonded boxes, cartons, or other containers. Hot melt thermoplastic adhesives are commonly used in such packaging applications where the rapid setting time of this type of adhesive is beneficial.

Assembled containers are eventually filled with an amount of a product and sealed to form a closed vessel with the product confined inside the closed vessel. If the applied adhesive is improperly positioned, gaps may be present between the joint flaps or the joint flaps may separate or be partially breached, for example, during shipping. This lack or absence of seal continuity causes a loss of product confinement and may result in leakage of, or damage to, all or part of the held product. Therefore, it is desirable to detect improper placement of the adhesive bead(s) after the adhesive is applied and without individual inspection of the containers.

Applicator systems on high-speed variable velocity production lines require that the response time for the applicator be adjusted to apply the adhesive at the desired location(s). Because of intrinsic mechanical and electrical system delays, such applicator systems require response time compensation to accurately place the adhesive on the workpiece. The response time compensation corrects for time delays between the instant that an electrical pulse is sent by a controller to the applicator and actual adhesive contact with the workpiece, and similar delays in discontinuing adhesive application. Contributing factors include the time-of-flight of the airborne adhesive in traveling from the applicator to the workpiece, transducer delays, delays arising from inductance of solenoid coils in solenoid-operated applicator valves, and delays due to the mechanical response time of the applicator valve.

In one conventional approach for setting response time compensation, a production line operator empirically measures the location of the adhesive and manually enters a response time compensation during a system initialization or start-up phase. This procedure has substantial potential for error, as the operator may incorrectly measure the location, or may incorrectly program the controller. Once the response time compensation is set, changes in operating parameters (i.e., changes in adhesive pressure, adhesive viscosity, or line velocity) may cause unwanted shifts in adhesive placement on the workpiece. In an iterative procedure, the operator must measure the applied location of the treatment and adjust the response time compensation until the applied location matches the desired location. This iterative procedure is a time consuming process as it requires several repetitions, thereby reducing line productivity.

Conventional automated adhesive applicators for high speed variable velocity production lines regulate adhesive placement by monitoring system operating parameters. Such automated applicator systems have an encoder that senses the line velocity of the conveyor, an applicator, an adhesive sensor that monitors adhesive placement on the workpiece, and a position detector that senses the presence of a portion (i.e., leading or trailing edge) of a conveyed workpiece at a known distance from the applicator nozzle. The controller of a control unit orchestrates the operation of the applicator (i.e. opening and closing of the applicator's solenoid-operated valve) in response to the signals received from the encoder, the adhesive sensor and the position detector.

The system control unit opens the applicator valve to discharge adhesive, which is supplied under pressure to the applicator, in a predetermined pattern through the applicator's nozzle. The system control unit also closes the valve to halt the discharge of adhesive from the nozzle. The discharge of adhesive is synchronized with the line velocity to achieve proper adhesive placement on the workpiece. The duration over which the valve is open, in conjunction with the line velocity, defines the length of the dispensed adhesive pattern. Signals supplied from the encoder and position detector to the system control unit determine the timing of trigger signals that open and close the applicator. The adhesive sensor detects the actual location of the applied adhesive.

An operator selects initial values for response time compensation from charts, or other references, during the system start-up phase and enters these initial values into a system controller for the automated adhesive applicator. An iterative procedure is used to adjust the response time compensation to provide accurate adhesive placement. The response time compensation is presumed to change linearly with a change in the line velocity. However, this predictive approach neglects any changes in the line velocity (i.e., acceleration) that may occur. The predictive approach also ignores any changes in other operational parameters, such as adhesive pressure and temperature.

It would therefore be desirable to provide an improved control system and method for regulating the placement of adhesive on conveyed workpieces in high-speed variable velocity production lines that can more accurately account for changes in operating parameters such as, for example, adhesive pressure, adhesive temperature, and line velocity.

SUMMARY OF THE INVENTION

In another embodiment of the invention, a method is provided for operating a dispensing system. The method includes transporting a workpiece in a direction intersecting a detection point of a position detector and an application point of an applicator, measuring a first numerical value of an operating parameter of the dispensing system, and detecting the presence of the transported workpiece at the detection point after the first value of the operating parameter is measured. The application point is downstream from the detection point. The method further includes measuring a second numerical value of the operating parameter after the transported workpiece is detected and before a material is discharged from the applicator and then predicting a third numerical value of the operating parameter from the measured first and second numerical values of the operating parameter. The method further includes defining a start time measured from the detection of the presence of the transported workpiece and based upon the third numerical value of the operating parameter at which to initiate dispensing of a material from the applicator. An amount of the material is dispensed from the applicator beginning at the first time for subsequent application at the application point onto the transported workpiece.

In another embodiment of the invention, a method for calibrating a dispensing system includes specifying a target start position on a workpiece for receiving an amount of a material and transporting a plurality of the workpieces in a direction intersecting a detection point of a position detector and an application point of an applicator. Each workpiece is transported past the detection and application points with an operating parameter of the dispensing system set to a corresponding one of a plurality of numerical values. The method further includes dispensing the amount of the material onto each of the transported workpieces, measuring an actual start position of the amount of material dispensed onto each of the transported workpieces, and comparing the target and actual start positions on each of the transported workpieces to yield a start error for the dispensed amount of the material on each of the transported workpieces. A mathematical relationship is derived for a start response compensation that describes the start error as a function of the operating parameter.

Various benefits and advantages of the present invention shall be made apparent from the accompanying drawings of the illustrative embodiment and the description thereof.

BRIEF DESCRIPTION OF THE DRAWINGS

The accompanying drawings, which are incorporated in and constitute a part of this specification, illustrate embodiments of the present invention and, together with a general description of the present invention given above, and the detailed description of the embodiments given below, serve to explain the principles of the present invention.

DETAILED DESCRIPTION OF THE PREFERRED EMBODIMENTS

Figure 1:
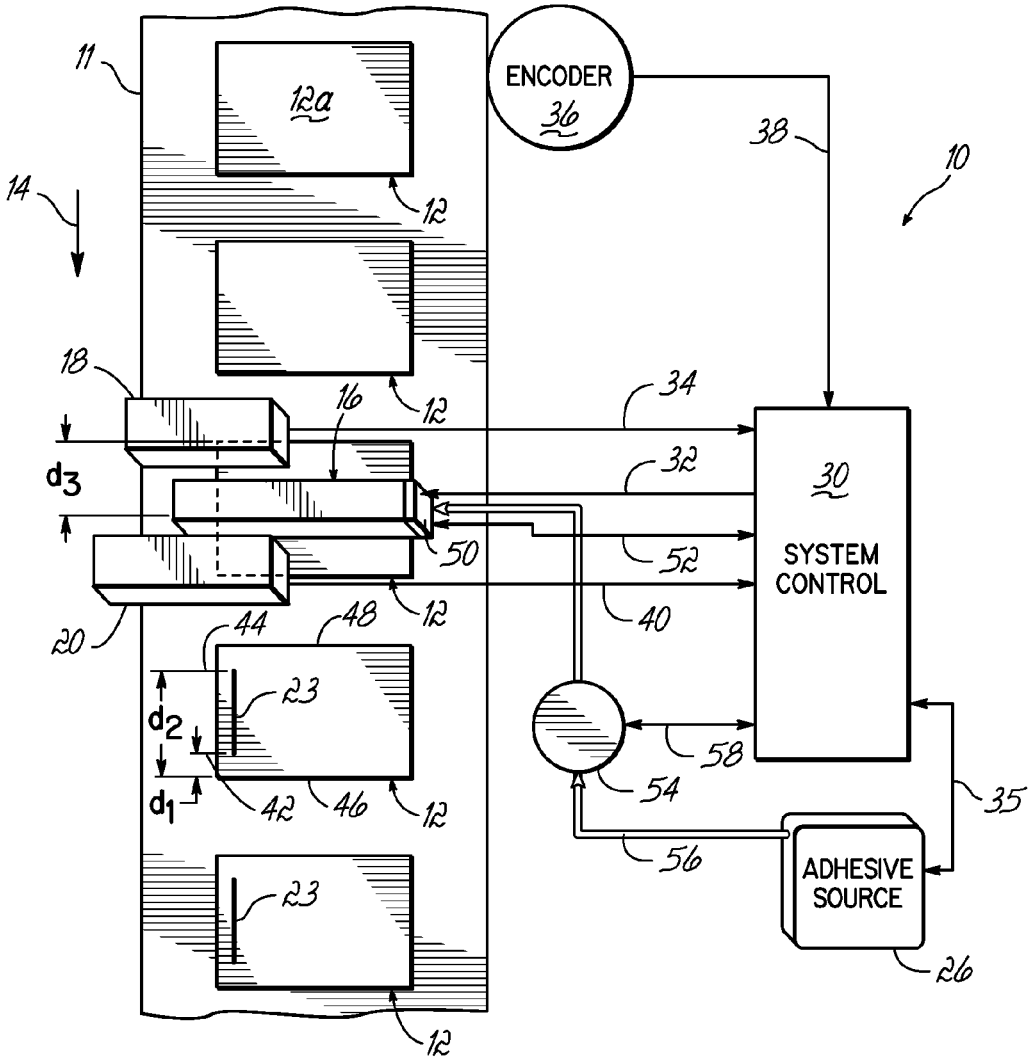
FIG. 1 is a diagrammatic view of an applicator system in accordance with an embodiment of the present invention.
Figure 2:
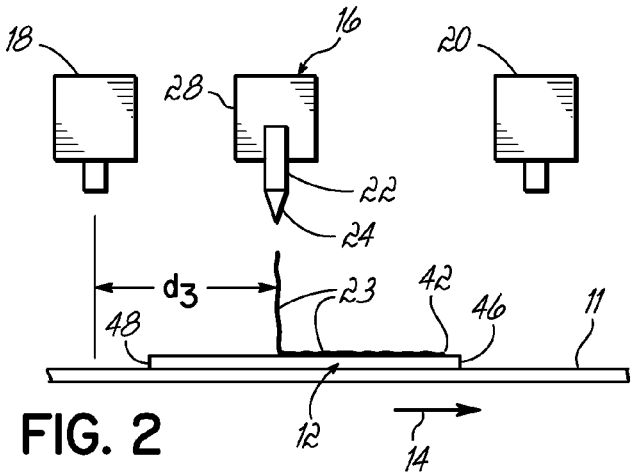
FIG. 2 is an enlarged diagrammatic view of a portion of FIG. 1.

With reference to FIGS. 1 and 2, an applicator system 10 includes a conveyor 11 moving in an upstream-to-downstream direction, generally indicated by a single-headed arrow 14, an adhesive applicator 16 suspended above the conveyor 11, a position detector 18, and an adhesive sensor 20. The position detector 18 is positioned upstream from the adhesive applicator 16. The adhesive sensor 20 is positioned upstream from the adhesive applicator 16. A series of substantially identical substrates or workpieces 12, such as carton or box blanks, is sequentially transported by the conveyor 11 past the applicator 16 as part of, for example, a packaging operation or a package assembly operation.

The applicator 16 includes a gun or module 22 equipped with a valve (not shown) capable of dispensing an amount 23 of a dispensable material, such as a hot melt adhesive, from a nozzle 24 coupled hydraulically with the outlet of the module 22. An exemplary module 22 is the E401 liquid adhesive electric gun available commercially from Nordson Corporation of Westlake, Ohio. The invention contemplates that applicator system 10 may be equipped with a plurality of individual modules (not shown) identical to module 22, each module 22 being connected to either a common or an independent adhesive source 26 and each module 22 capable of applying the amount 23 of adhesive to workpiece 12. The plurality of modules 22 may be arranged in parallel or staggered rows in the cross direction orthogonal to direction 14.

Adhesive is pumped from the adhesive source 26, such as a hot melt adhesive melter, to a service block or manifold 28 supporting the applicator 16. The manifold 28 includes internal passageways (not shown) supplying adhesive to module 22. The manifold 28 may also include internal heaters (not shown) that transfer heat to the hot melt adhesive, so as to maintain the adhesive at its proper application temperature.

The nozzle 24 is constructed with a slot or one or more orifices arranged to dispense the amount 23 of adhesive onto a surface 12*a* of each individual workpiece 12. The pattern of the adhesive amount 23 applied through the slot or orifice(s) to one of the workpieces 12 and measured along the travel direction 14 may be a lengthwise continuous bead or interrupted along its length to create multiple line segments each consisting of a discrete amount of adhesive. Although the applied material or fluid is described as a hot melt adhesive, the invention is not so limited, as the applicator system 10 may apply other types of materials such as inks, different types of adhesives including cold glues and epoxies, gasketing materials, sealants, caulks, coatings, fluxes, encapsulants, and paints.

With continued reference to FIGS. 1 and 2, the position detector 18, also suspended above the conveyor 11, has a field of view adequate to sense the presence or absence of a reference portion of each workpiece 12 approaching the applicator 16 and generates an output signal. For example, the position detector 18 may detect or sense either a leading edge 46 or a trailing edge 48 of each successive workpiece 12 and generate an output signal representative of the presence of the corresponding sensed edge 46, 48. The position detector 18 may be an optical sensor or photodetector operating in a conventional sensing mode, an inductive sensor, a capacitive sensor, or other type of known sensor. A suitable position detector 18 is the SM312DB infrared sensor commercially available from Banner Engineering Corp. of Minneapolis, Minn.

The applicator 16 is interfaced with a programmable pattern or system control 30, which has a controller that outputs control signals over a line 32 to the applicator 16 for opening and closing the valve of the module 22. The controller outputs these control signals in response to a trigger signal received by system control 30 over a line 34 from position detector 18. The targeted adhesive amount 23 is entered into the system control 30, which executes stored software algorithms and contains control circuitry that cooperate to generate control signals to the applicator 16 appropriate to generate a pattern and/or length for the adhesive amount 23. It will be readily apparent that the various methods and algorithms described herein may be implemented by, e.g., an appropriately programmed processor (e.g., microprocessor) of the system control 30. Typically, the processor will receive instructions from a memory or like device, and execute those instructions, thereby performing a process defined by those instructions. Programs that implement such methods and algorithms may be stored and transmitted using a variety of known media. The system control 30 is also interfaced over a line 35 with the electronics of adhesive source 26 for regulating the pressure and temperature of the adhesive pumped from adhesive source 26 to the applicator 16.

The system control 30 provides, either directly or indirectly, electrical power for driving an air-operated solenoid that supplies air pressure to module 22 in such a manner so as to control the opening and closing of the valve of the module 22. The controlled opening and closing produces start and stop positions 42, 44 (FIG. 3) for the amount 23 of adhesive on successive workpieces 12. Alternatively, the system control 30 may control an electrically-operated solenoid of module 22, which drives an armature relative to a valve seat to thereby control the flow of the adhesive from the nozzle 24 and application on successive workpieces 12.

The system control 30 is electrically coupled over a line 38 with an encoder 36 that continuously transmits a string of pulses with a frequency related to conveyor movement to system control 30. The number of pulses per unit length of conveyor movement communicates displacement information concerning the conveyor 11 and workpieces 12 to the system control 30. The number of pulses per unit time determines the line velocity of the conveyor 11, and the line acceleration is determined from the change in velocity per unit time. The encoder 36 may be any type of conventional encoder, such as a shaft encoder. As a specific example, the encoder 36 may be a rotary position transducer coupled with the shaft of a conveyor roller or with the output shaft of a motor powering the conveyor 11. Such rotary position transducers are commercially available, for example, from Encoder Products Company of Sagle, Id. The system control 30 is interfaced with a parent machine for controlling the line velocity of conveyor 11.

With continued reference to FIGS. 1 and 2, the adhesive sensor 20, also suspended above the conveyor 11, is positioned with a field of view sufficient to sense the placement of adhesive amount 23 on the surface 12*a* of workpiece 12. The adhesive sensor 20 generates an output signal over a line 40 to system control 30 representative of start and stop positions 42, 44 (FIG. 3) of the applied amount 23. The adhesive sensor 20 may be, for example, an infrared or thermal detector, an ultrasonic detector, a capacitive sensor, a microwave sensor, an optical sensor, etc. depending, among other things, upon the type of adhesive being dispensed. A suitable adhesive sensor 20 is the HD100 glue sensor commercially available from Nordson Corporation of Westlake, Ohio.

Based upon the output signals arriving from adhesive sensor 20 and encoder 36, the system control 30 may determine the distance, $d_1$, between an actual start position 42 of the amount 23 and the leading edge 46 of each successive workpiece 12, and the distance, $d_2$, between an actual stop position 44 of the amount 23 and the leading edge 46. Alternatively, other reference points 12, such as the trailing edge 48 of workpiece 12, may be used for determining the actual stop and start positions 42, 44. The start and stop positions 42, 44 are determined on each workpiece 12 as successive workpieces 12 are continuously transported by the conveyor 11 past the adhesive applicator 16. The start and stop positions 42, 44 define the location of the leading and trailing edges, respectively, of the adhesive amount 23 and the difference between the start and stop positions 42, 44 defines the length of the continuous or discontinuous bead of material on the workpiece 12 measured along the travel direction 14.

With continued reference to FIGS. 1 and 2, the system control 30 is electrically coupled with a temperature transducer 50, such as a resistance thermal detector (RTD), that monitors the temperature of the applicator 16 or the manifold 28 of applicator 16. The monitored temperature is representative of the temperature of the adhesive flowing through the internal passageways of manifold 28. The temperature transducer 50 continuously generates and transmits an output signal representative of the measured temperature over a line 52 to the system control 30.

The system control 30 is also electrically coupled with a pressure transducer 54, which is installed in a hose 56 coupling the adhesive source 26 with manifold 28. The pressure transducer 54 monitors the pressure of the adhesive flowing in hose 56. The pressure transducer 54 continuously generates and transmits an output signal representative of the monitored pressure over a line 58 to the system control 30. The output signals from the temperature transducer 50 and the pressure transducer 54 are digitized and stored by the system control 30.

The adhesive applicator 16, position detector 18, adhesive sensor 20, and system control 30 constitute individual components of a closed loop applicator system that accurately regulates the placement of the adhesive amount 23 on the surface 12*a* of each workpiece 12 sequentially transported past the applicator 16. To that end, the system control 30 acquires the actual start and stop positions 42, 44 of the amount 23 relative to the chosen reference point on the workpiece 12 as a function of the adhesive temperature measured by temperature transducer 50, the adhesive pressure sensed by pressure transducer 54, and the line velocity measured by encoder 36. The system control 30 may store this measured information in a database for future reference.

Figure 3:
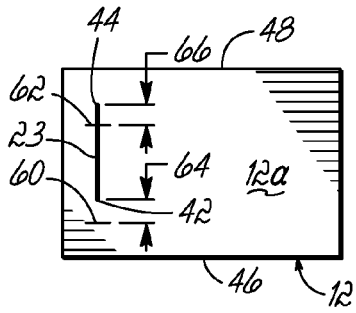
FIG. 3 is a view of a workpiece with a pattern of adhesive applied by the applicator system of FIG. 1.

With reference to FIG. 3, the system control 30 stores a programmed start position 60 and a programmed stop position 62 suitable to form the amount 23 of adhesive on each workpiece 12. A start response time (i.e., programmed start delay) for triggering adhesive applicator 16 to initiate adhesive application at the programmed start position 60 is given by the distance $d_3$, which is measured between a first point defined by the intersection of the field of view of the position detector 18 and the leading edge 46 of workpiece 12 and a second point defined by initial contact between adhesive discharged from the module 22 and workpiece 12, divided by the measured line velocity. A stop response time (i.e., programmed stop delay) to discontinue the application of adhesive at the programmed stop position 62 is defined by the distance $d_3$ plus the length of the amount 23 divided by the line velocity. The programmed start and stop delays are corrected with start and stop response time compensations, respectively, as explained hereinafter.

If position of the actual measured adhesive amount 23 is shifted relative to the desired pattern along the travel direction 14, the system control 30 introduces a response compensation to either increase or decrease the response time of the applicator 16. A start error results if the actual start position 42 does not coincide with the programmed start position 60. A value for start response compensation is defined as the difference between the actual start position 42 and the programmed start position 60 (i.e., the start error) divided by the line velocity. Similarly, a stop error results if the actual and programmed stop positions 44, 62, respectively, differ. A value for the stop response compensation is defined as the difference between the actual stop position 44 and the programmed start position 62 (i.e., the stop error) divided by the line velocity.

Figure 4:
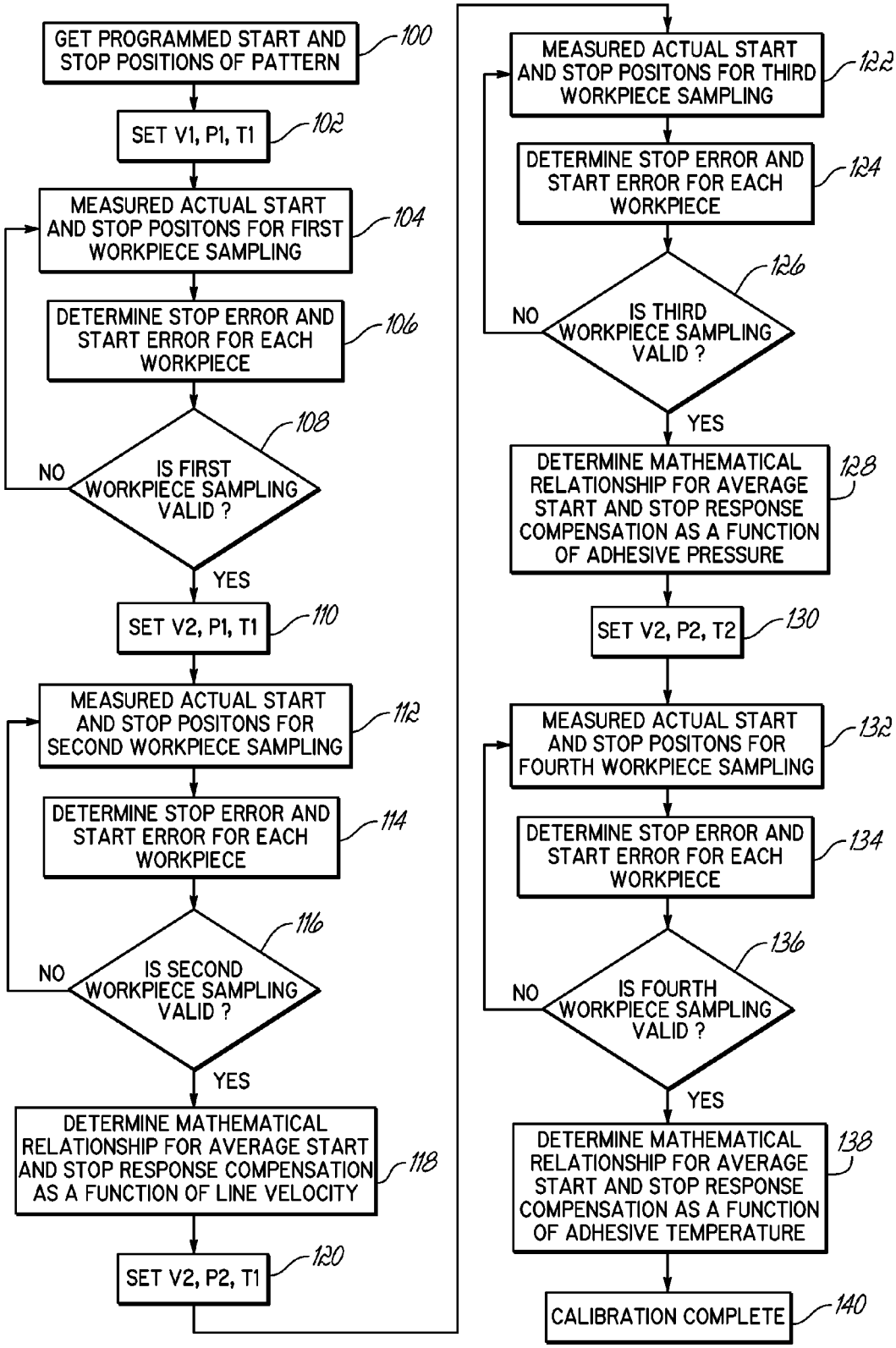
FIG. 4 is a flow chart representing a method of calibrating the applicator system of FIG. 1.

With reference to FIG. 4, a calibration procedure for applicator system 10 will be described. The calibration procedure will be described as deriving mathematical relationships to determine start and stop distance response compensation as a function of multiple operating parameters, such as line velocity, adhesive pressure, and adhesive temperature. However, it is understood that mathematical relationships may be developed for only one of these operating parameters or for two of these operating parameters, rather than all three operating parameters, or may be developed for other arbitrary operating parameters or sets or operating parameters either individually or in combination.

In block 100, the system control 30 (FIG. 1) retrieves targeted or programmed start and stop positions 60, 62 (FIG. 3) intended for the adhesive amount 23 (FIG. 1). The programmed start and stop positions 60, 62 may be representative of a test pattern or representative of an actual adhesive amount 23 to be applied to workpiece 12 (FIG. 3). In block 102, the system control 30 adjusts the operation of adhesive source 26 (FIG. 1) to supply a stream of adhesive through hose 56 to the applicator 16 (FIG. 1) at a first adhesive pressure ($P_1$), as sensed with the pressure transducer 54 (FIG. 1), and a first adhesive temperature ($T_1$), as sensed with temperature transducer 50 (FIG. 1). The system control 30 sets the line velocity of conveyor 11 (FIG. 1) to a first line velocity ($V_1$), as verified by output signals supplied to system control 30 from encoder 36 (FIG. 1).

The system control 30 then instructs the applicator 16 to apply the adhesive amount 23 to each workpiece 12 from among a first test sampling of workpieces 12. The number of workpieces 12 in the first test sampling is arbitrary but selected numerically with the expectation of providing a statistically significant sample.

In block 104, the adhesive sensor 20 detects the actual start and stop positions 42, 44 (FIG. 3) of the adhesive amount 23 on each workpiece 12 among the first test sampling at the first adhesive pressure, first adhesive temperature, and first line velocity. The actual start and stop positions 42, 44 are communicated by the adhesive sensor 20 to the system control 30. In block 106, the system control 30 determines a start error for each workpiece 12 of the first test sampling as the difference between the actual and programmed start positions 42, 60. Similarly, the system control 30 determines a stop error for each workpiece 12 of the first test sampling as the difference between the actual and programmed stop positions 44, 62.

If the first test sampling is invalid, block 108 returns program control to block 102 and the actual stop and start positions 42, 44 of amount 23 are measured for another first test sampling of workpieces 12 at the same line velocity, pressure, and temperature. The results of the repeated first test sampling may be combined with the results of the initial first test sampling or, if necessary, the results of the initial first test sampling may be discarded. Alternatively, the system control 30 may abort the calibration procedure if the first test sampling is invalid. The first test sampling may be designated as statistically invalid if the statistical standard deviation or variance of either the start error or the stop error exceeds respective predefined upper limits. If the first test sampling is statistically valid, average start and stop errors are determined for all workpieces 12 in the first test sampling and stored by system control 30. Block 108 then transfers program control to block 110.

With continued reference to FIG. 4 and in block 110, the system control 30 sets the line velocity of conveyor 11 to a second line velocity ($V_2$), as verified by output signals supplied to system control 30 from encoder 36, that differs from the first line velocity. The adhesive pressure and adhesive temperature are held constant at the values set during the first test sampling. The system control 30 instructs the applicator 16 to apply the adhesive amount 23 to each of a second test sampling of workpieces 12. The number of workpieces 12 in the second test sampling is arbitrary but selected numerically with the expectation of providing a statistically significant sample.

In block 112, the adhesive sensor 20 detects the actual start and stop positions 42, 44 of the amount 23 on each workpiece 12 among the second test sampling at the first adhesive pressure, first adhesive temperature, and second line velocity. The adhesive sensor 20 communicates the actual start and stop positions 42, 44 of the amount 23 to the system control 30. In block 114, the system control 30 determines a start error for each workpiece 12 of the second test sampling as the difference between the actual and programmed start positions 42, 60 and a stop error for each workpiece 12 as the difference of the second test sampling between the actual and programmed stop positions 44, 62.

If the second test sampling is statistically invalid, block 116 returns program control to block 112 and the actual stop and start positions 42, 44 of amount 23 are measured for another second test sampling of workpieces 12. The results of the repeated second test sampling may be combined with the results of the initial second test sampling or the results of the initial second test sampling may be discarded. Alternatively, the system control 30 may abort the calibration procedure. Similar to the process for the first test sampling, the second test sampling is designated as invalid if the statistical variance in the start and stop errors exceeds respective predefined upper limits. If the second test sampling is statistically valid, the average start and stop errors for the second test sampling are determined and stored by system control 30 and block 116 transfers program control to block 118.

In block 118, the system control 30 establishes the start response compensation as a mathematical relationship of the start error as a function of line velocity for constant adhesive temperature and pressure. The mathematical relationship is determined using the two data points defined by the average start error for the first test sampling and the average start error for the second test sampling. The system control 30 likewise establishes the stop response compensation as a mathematical relationship relating the stop error to line velocity for a constant temperature and pressure. The mathematical relationship is determined using the data points defined by the average stop error for the first test sampling and the average stop error for the second test sampling.

The system control 30 stores the mathematical relationships derived for the start and stop response compensation as a function of line velocity for future use. The system control 30 also stores the individual and/or average start and stop errors at each of the two line velocities for future use in a three-dimensional (i.e., line velocity, adhesive pressure, adhesive temperature) data matrix or database. It will be understood by one of ordinary skill in the art that alternative database structures to those described may be readily employed and that other memory structures besides databases may be readily employed. Program control is then transferred to block 120.

The mathematical relationships for start and stop response compensation are lines each determined by a linear regression from the start and stop errors, respectively, for the two different line velocities and characterized by a slope and y-intercept. The line velocity component of the calibration procedure may be repeated for additional line velocities by repeating the steps in blocks 110-118. In each instance, the selected line velocity will differ from other calibrated line velocities. The average start and stop errors at each different line velocity present additional data points available for parameterizing the mathematical relationships for start and stop response compensation, each of which may be linear or non-linear, by curve fitting.

With continued reference to FIG. 4 and in block 120, the system control 30 sets the adhesive pressure to a second adhesive pressure ($P_2$), as verified by output signals supplied to system control 30 from pressure transducer 54, that differs from the first adhesive pressure. The line velocity and adhesive temperature are held constant at the second line velocity and first adhesive temperature, respectively. The system control 30 instructs the applicator 16 to apply the amount 23 of adhesive to each of a third test sampling of workpieces 12. The number of workpieces 12 in the third test sampling is arbitrary but selected numerically with the expectation of providing a statistically significant sample.

In block 122, the adhesive sensor 20 detects the actual start and stop positions 42, 44 of the amount 23 on each workpiece 12 among the third test sampling at the second adhesive pressure, first adhesive temperature, and second line velocity. The adhesive sensor 20 communicates the actual start and stop positions 42, 44 of the amount 23 to the system control 30. In block 124, the system control 30 determines a start error for each workpiece 12 in the third test sampling as the difference between the actual and programmed start positions 42, 60. Similarly, the system control 30 determines a stop error for each workpiece 12 of the third test sampling as the difference between the actual and programmed stop positions 44, 62.

If the third test sampling is statistically invalid, block 126 returns program control to block 122 and the actual stop and start positions 42, 44 of amount 23 are measured for another third test sampling of workpieces 12. The results of the initial third test sampling may be combined with the results of the repeated third test sampling, the results of the initial third test sampling may be discarded, or the system control 30 may abort the calibration procedure. Similar to the process described above for the first and second test samplings, the third test sampling is designated as invalid if the statistical variance in the start and stop errors exceeds respective predefined upper limits.

If the third test sampling is statistically valid, the average start and stop errors for the third test sampling are determined and stored by system control 30 and block 126 transfers program control to block 128. In block 128, the system control 30 establishes the start response compensation as a mathematical relationship relating the start error as a function of adhesive pressure for constant line velocity and adhesive temperature. The mathematical relationship is determined using the two data points defined by the average start error for the second test sampling and the average start error for the third test sampling. The system control 30 likewise establishes the stop response compensation as a mathematical relationship relating the stop error to adhesive pressure for constant line velocity and adhesive temperature. The mathematical relationship is determined using the data points defined by the average stop error for the second test sampling and the average stop error for the third test sampling.

The system control 30 stores the mathematical relationships derived for the start and stop response compensation as a function of adhesive pressure for future use. The system control 30 also stores the individual and/or average start and stop errors at each of the two adhesive pressures for future use in the data matrix. Program control is then transferred to block 130.

The mathematical relationships for start and stop response compensation are lines each determined by a linear regression from the start and stop errors, respectively, for two different adhesive pressures and characterized by a slope and y-intercept. The adhesive pressure component of the calibration procedure may be repeated for additional adhesive pressures by repeating the steps in blocks 120-128. In each instance, the selected adhesive pressure will differ from other calibrated adhesive pressures. The average start and stop errors at each different adhesive pressure constitute additional data points available to parameterize the mathematical relationships, each of which may be linear or non-linear, by curve fitting.

With continued reference to FIG. 4 and in block 130, the system control 30 sets the adhesive temperature to a second adhesive temperature ($T_2$), as verified by output signals supplied to system control 30 from temperature transducer 50, that differs from the first adhesive temperature. The line velocity and adhesive pressure are held constant at the second line velocity and the second adhesive pressure. The system control 30 instructs the applicator 16 to apply the amount 23 of adhesive to each of a fourth test sampling of workpieces 12. The number of workpieces 12 in the fourth test sampling is arbitrary but selected numerically with the expectation of providing a statistically significant sample.

In block 132, the adhesive sensor 20 detects the actual start and stop positions 42, 44 of the amount 23 on each workpiece 12 among the fourth test sampling at the second adhesive pressure, second adhesive temperature, and second line velocity. The adhesive sensor 20 communicates the actual start and stop positions 42, 44 of the amount 23 to the system control 30. In block 134, the system control 30 determines a start error for each workpiece 12 in the fourth test sampling as the difference between the actual and programmed start positions 42, 60. Similarly, the system control 30 determines a stop error for each workpiece 12 of the fourth test sampling as the difference between the actual and programmed stop positions 44, 62.

If the fourth test sampling is statistically invalid, block 136 returns program control to block 132 and the actual stop and start positions 42, 44 of amount 23 are measured for another fourth test sampling of workpieces 12. The results of the repeated fourth test sampling may be combined with the results of the initial fourth test sampling or the results of the initial fourth test sampling may be discarded. Alternatively, the system control 30 may abort the calibration procedure. Similar to the process for the previous test samplings, the fourth test sampling is designated as invalid if the statistical variance in the start and stop errors exceeds respective predefined upper limits.

If the fourth test sampling is statistically valid, the average start and stop errors for the fourth test sampling are determined and stored by system control 30 and block 136 transfers program control to block 138. In block 138, the system control 30 establishes the start response compensation as a mathematical relationship for the start error as a function of adhesive temperature for constant line velocity and adhesive pressure. The mathematical relationship is determined using the two data points defined by the average start error for the third test sampling and the average start error for the fourth test sampling. The system control 30 likewise establishes the stop response compensation as a mathematical relationship for the stop error to adhesive temperature for constant line velocity and adhesive pressure. The mathematical relationship is determined using the data points defined by the average stop error for the third test sampling and the average stop error for the fourth test sampling.

The system control 30 stores the mathematical relationships for the start and stop response compensation as a function of adhesive pressure for future use. The system control 30 stores also the individual and/or average start and stop errors at each of the two adhesive temperatures for future use in the data matrix. Program control is then transferred to block 140 and the calibration is concluded, unless additional operating parameters can be measured and considered to provide a mathematical relationship for start and stop response compensation.

The mathematical relationships for start and stop response compensation are lines each determined by a linear regression from the start and stop errors, respectively, for two different adhesive temperatures and characterized by a slope and y-intercept. The adhesive temperature component of the calibration procedure may be repeated for additional adhesive temperatures by repeating the steps in blocks 130-138. In each instance, the selected adhesive temperature will differ from other calibrated adhesive temperatures. The average start and stop errors at each different adhesive temperature present an additional data point available for curve fitting to parameterize the mathematical relationships, which may be linear or non-linear.

The information and mathematical relationships derived from the calibration procedure are available for future use in applying the amount 23 of adhesive to successive workpieces 12. The applicator system 10 may correct measured start and stop errors based upon line velocity, adhesive temperature, adhesive pressure, or any combination of these operating parameters.

Figure 5:
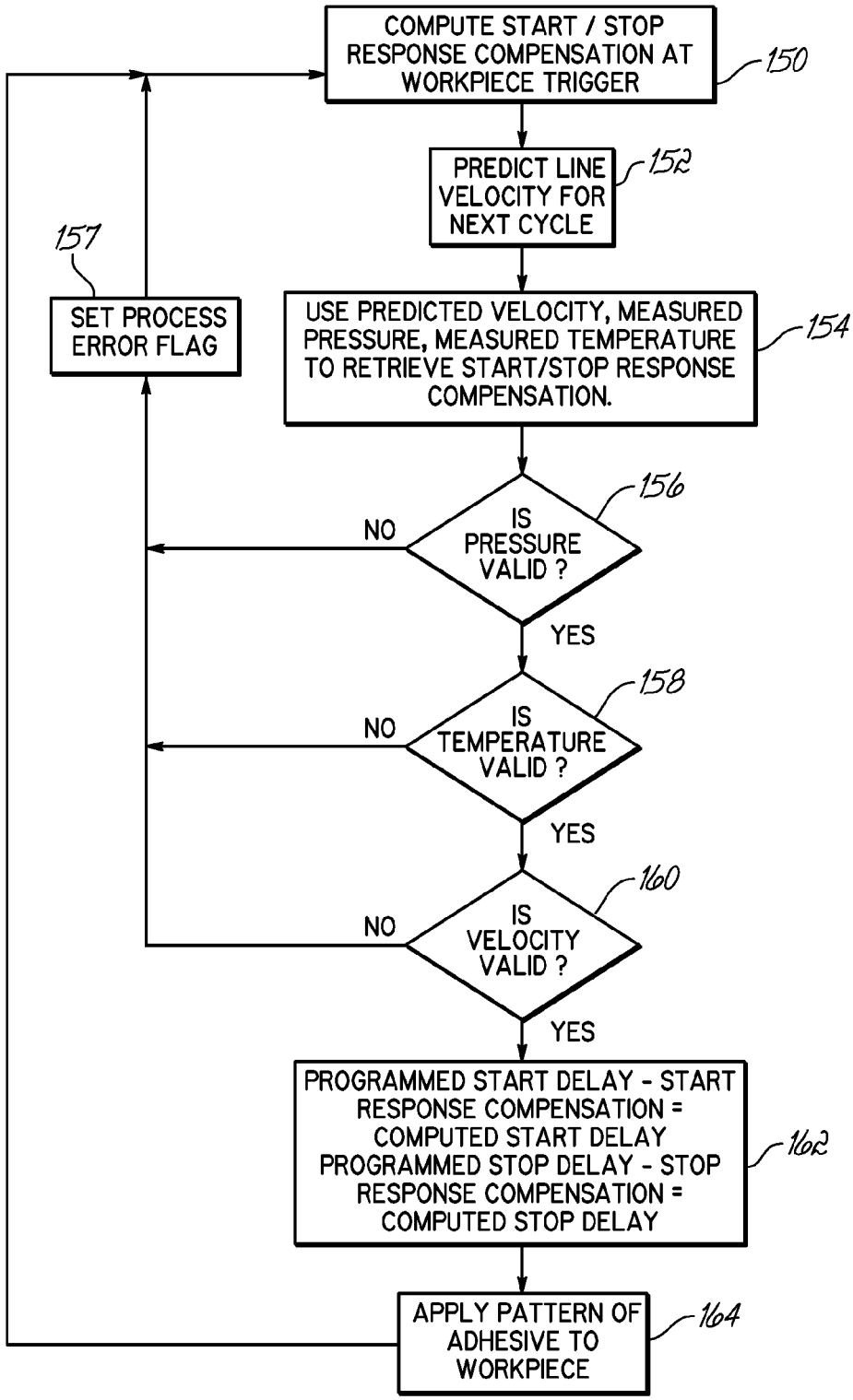
FIG. 5 is a flow chart representing a method of operating the applicator system of FIG. 1 in accordance with an embodiment of the present invention.

With reference to FIG. 5, a start distance response compensation and a stop distance response compensation are determined for the dispensing of the adhesive amount 23 (FIG. 1) onto each workpiece 12 to correct for variations in line velocity. The following description is equally valid for predicting adhesive location in the dispensed amount 23 based upon other operating parameters, such as adhesive temperature, adhesive pressure, both of these operating parameters, or any combination of either or both of these operating parameters with line velocity. The start and stop distance compensations are predicted based upon a rate of change in the relevant operating parameter(s).

In block 150, the procedure for determining the appropriate start and stop response compensations is initiated when position detector 18 detects the leading edge 46 (FIG. 1) of an arriving workpiece 12 and supplies an output signal to trigger system control 30 (FIG. 1). In block 152, the system control 30 receives a signal from the encoder 36 (FIG. 1) representative of the line velocity of the workpiece 12. The system control 30 then predicts a line velocity at the instant that material is discharged from the applicator 16 (FIG. 1) based upon the two measured line velocities, which takes into account the rate change in line velocity (i.e., acceleration) since the last line velocity measurement made during the previous, or an even earlier, dispensing cycle. For example, acceleration may be calculated from the first and second values of the line velocity and the classical equation for rectilinear motion with constant acceleration used to predict the line velocity at the future time that material is discharged from the applicator 16 or the time at which the discharged material strikes the workpiece 12.

The adhesive temperature and pressure are measured using the temperature and pressure transducers 50, 54, respectively, at approximately the same time that the line velocity is measured. The system control 30 may also predict the adhesive temperature and/or the adhesive pressure based upon the adhesive temperature and the adhesive pressure, respectively, during the previous dispensing cycle and the rate of change in either the adhesive pressure or adhesive temperature since the previous, or an even earlier, dispensing cycle.

In block 154, the system control 30 determines the start response compensation and the stop response compensation at the predicted velocity, the measured adhesive temperature, and the measured adhesive pressure. The start response compensation determined by the system control 30 is equal to the sum of the individual components of the start response compensation for line velocity, adhesive pressure, and adhesive temperature determined during the calibration procedure. Accordingly, the start response compensation is the sum of the line velocity component of the start time response compensation evaluated at the predicted line velocity, the adhesive pressure component of the start time response compensation evaluated at the measured adhesive pressure, and the adhesive temperature component of the start time response compensation evaluated at the measured adhesive temperature. Each component may be evaluated as a value calculated from the corresponding mathematical relationship resulting from curve fitting or by looking up a value (potentially with interpolation) in the corresponding table of the data matrix.

Similarly, the stop response compensation determined by the system control 30 is equal to the sum of the individual components of the stop response compensation for line velocity, adhesive pressure and adhesive temperature determined during the calibration procedure. Accordingly, the stop response compensation is the sum of the line velocity component of the stop time response compensation evaluated at the predicted line velocity, the adhesive pressure component of the stop time response compensation evaluated at the measured adhesive pressure, and the adhesive temperature component of the stop time response compensation evaluated at the measured adhesive temperature. Each component may be evaluated as a value calculated from the corresponding mathematical relationship resulting from curve fitting or by looking up a value (potentially with interpolation) in the corresponding table of the data matrix.

As mentioned above, the start and stop response compensations may also take into account a rate change in the adhesive pressure and/or the adhesive temperature, as well as the rate change in the line velocity as described above. For example, if rate changes in the line velocity and adhesive pressure are considered, the start and stop response compensations will be evaluated at the predicted line velocity, the predicted adhesive pressure, and the measured adhesive temperature.

The start response compensation determined by system control 30 is corrected to account for any delay introduced by the response time of the adhesive sensor 20 (FIG. 1). Specifically, the adhesive sensor 20 has an on-time delay resulting from the time required for sensor 20 to turn on, which is subtracted from the value of the start response compensation. Similarly, the stop response compensation determined by system control 30 is also corrected to account for any delay introduced by the response time of the adhesive sensor 20. Specifically, the adhesive sensor 20 has an off-time delay resulting from the time required for sensor 20 to turn off, which is subtracted from the value of the stop response compensation. The magnitude of the on-time delay and the off-time delay, which typically are not equal, is dependent upon the type and identity of the adhesive sensor 20.

It is appreciated by persons of ordinary skill in the art that the start and stop compensations may be evaluated as times or may be converted to distances using either the measured or predicted line velocity.

In block 156, the system control 30 verifies that the adhesive pressure is valid by comparing the measured adhesive pressure with a range of permitted adhesive pressures. An invalid adhesive pressure may result, for example, from a high-pressure event such as a clogged nozzle 24 (FIG. 2) or from a low-pressure event such as a pump failure at the adhesive source 26 (FIG. 1). If the adhesive pressure is valid, control is transferred to block 158. In block 158, the system control 30 verifies that the adhesive temperature is valid by comparing the measured adhesive temperature with a range of permitted adhesive temperatures.

If the adhesive temperature is valid, block 158 transfers control to block 160 in which the system control 30 verifies that the line velocity is valid by comparing the predicted line velocity with a range of permitted line velocities. An invalid line velocity may result, for example, from a faulty encoder 36 (FIG. 1) or encoder 36 chatter. If either the adhesive temperature, adhesive pressure, or line velocity are invalid, control is transferred by any of blocks 156, 158, and 160, respectively, to block 157 in which a process error flag is set. If control is transferred to block 157 for a sufficient number of successive workpieces 12, the system control 30 may instruct the parent machine supporting the applicator system 10 to halt line production so that the problem may be assessed. Otherwise, the transfer to block 157 is deemed aberrant and control is returned to block 150 to await the arrival of another workpiece 12.

In block 162, the system control 30 subtracts the start response compensation from the programmed start delay to define a computed start delay used by the system control 30 to initiate adhesive application from applicator 16 after the output signal is received from position detector 18. Similarly, the system control 30 subtracts the stop response compensation from the programmed start delay to define a computed stop delay used by the system control 30 to discontinue adhesive application from applicator 16. The start and stop delays may be converted from distance to time using either the measured or predicted line velocity. In block 164, the applicator 16 applies the amount 23 of adhesive to the workpiece 12 using the start and stop delays for initiating and discontinuing adhesive dispensing, and control is returned to block 150 to await the arrival of another workpiece 12.

Figure 6:
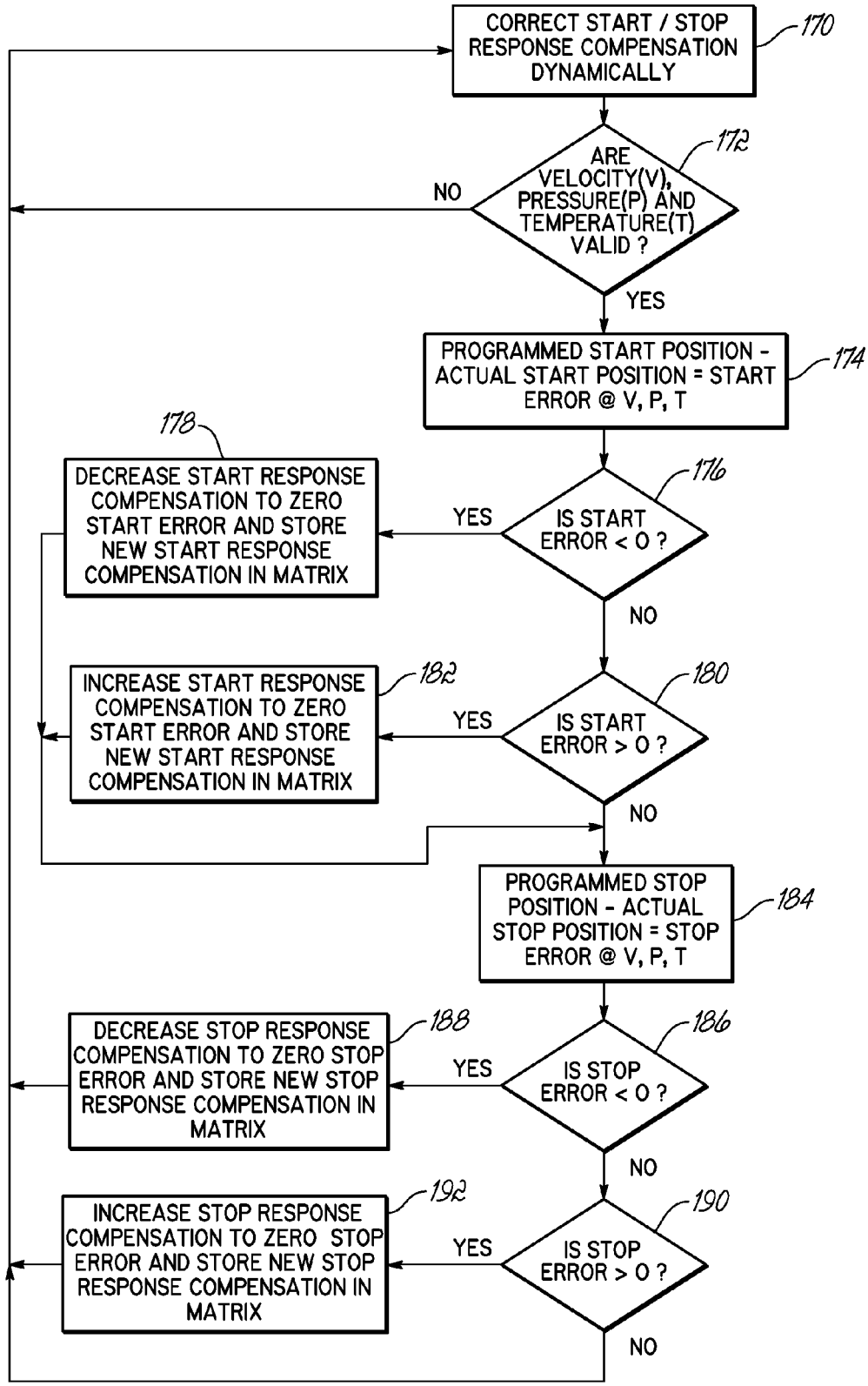
FIG. 6 is a flow chart representing a method of operating the applicator system of FIG. 1 in accordance with an embodiment of the present invention.

With reference to FIG. 6, a procedure for dynamically updating the start and stop errors contained in the data matrix and adjusting the mathematical relationships is presented. The updating process is described in terms of updating based upon line velocity, but also applies equally to updating based upon other operation parameters, such as adhesive pressure or adhesive temperature.

The dynamic compensation procedure is initiated in block 170 and may transpire concurrently with the start response compensation and stop response compensation procedure detailed in FIG. 5. In block 172, the system control 30 verifies that the line velocity, adhesive temperature, and adhesive pressure are within limits appropriate for adhesive application. If these parameters are invalid, system control 30 (FIG. 1) returns control to block 170 and awaits the receipt of the line velocity, adhesive temperature and adhesive pressure for the next workpiece 12 (FIG. 1). If these parameters are valid, system control 30 transfers control to block 174.

In block 174, the system control 30 determines a start error for the workpiece 12 as the difference between the actual and programmed start positions 42, 60 (FIG. 3). Control is transferred to block 176 in which the controller determines whether the start error is negative. If the start error is negative, control is transferred to block 178. In block 178, the system control 30 decreases the start response compensation to zero or nullify the negative start error, stores the new start response compensation in the data matrix, and transfers control to block 184. If the start error is not negative, control is transferred by block 176 to block 180.

In block 180, the system control 30 determines whether the start error is positive. If the start error is not positive, control is transferred by block 180 to block 184. If the start error is positive, control is transferred to block 182. In block 182, the system control 30 increases the start response compensation to zero or nullify the positive start error and stores the new start response compensation in the data matrix at the appropriate adhesive pressure, adhesive temperature and line velocity. Control is transferred to block 184. Of course, no change or update to the start response compensation occurs if the start error is zero.

In block 184, the system control 30 determines a stop error for the workpiece 12 as the difference between the actual and programmed stop positions 44, 62 (FIG. 3). Control is transferred to block 186 in which the system control 30 determines whether the stop error is negative. If the stop error is negative, control is transferred to block 188. In block 188, the system control 30 decreases the stop response compensation to zero or nullify the stop error and stores the new stop response compensation in the data matrix. Control is then returned to block 170 to await the arrival of the next workpiece 12. If the stop error is not negative, control is transferred by block 186 to block 190.

In block 190, the system control 30 determines whether the stop error is positive. If the stop error is not positive, control is transferred by block 190 to block 192. If the stop error is positive, control is transferred to block 170 to await the arrival of the next workpiece 12. In block 192, the system control 30 increases the stop response compensation to zero or nullify the stop error and stores the new stop response compensation in the data matrix error. The mathematical relationship governing the stop response compensation and/or the start response compensation may also be re-determined or updated using the stop error and start error, respectively, or the accumulated stop and start errors. Control is transferred to block 170 to await the arrival of the next workpiece 12. Of course, no change or update to the stop response compensation occurs if the stop error is zero.

While the invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit or scope of applicants' general inventive concept.

What is claimed is:

1. A method for calibrating a dispensing system having a position detector with a detection point and an applicator with an application point downstream from the detection point, the method comprising:

specifying a target start position on a workpiece for receiving an amount of a material transporting a first plurality of the workpieces and a second plurality of the workpieces in a direction intersecting the detection point and the application point;

as the first plurality of the workpieces are transported past the application point, dispensing the amount of the material onto each of the first plurality of workpieces with a first operating parameter of the dispensing system set at a first value;

as the second plurality of the workpieces are transported past the application point, dispensing the amount of the material onto each of the second plurality of workpieces with the first operating parameter of the dispensing system set at a second value;

detecting an actual start position of the amount of the material on each of the first plurality of the workpieces and on each of the second plurality of the workpieces;

comparing the actual start position for the amount of material on each of the first plurality of the workpieces and each of the second plurality of the workpieces with the target start position for the amount of material to yield a plurality of start errors correlated with the first parameter; and deriving a mathematical relationship from the plurality of start errors correlated with the first parameter, the first value of the first operating parameter, and the second value of the first operating parameter describing a start response compensation time for the dispensing system as a function of the first operating parameter of the dispensing system.

2. The method of claim 1 wherein the first operating parameter is a line velocity of each of the transported workpieces.

3. The method of claim 1 wherein the first operating parameter is a temperature of the dispensed material.

4. The method of claim 1 wherein the first operating parameter is a pressure of the dispensed material.

5. The method of claim 1 further comprising:

detecting an actual stop position of the amount of material dispensed onto each of the first plurality of the workpieces and the second plurality of the workpieces transported past the detection point and the application point;

comparing the actual stop position on each of the first plurality of the workpieces and the second plurality of the workpieces with a target stop position for the amount of material to yield a plurality of stop errors; and deriving a mathematical relationship from the plurality of stop errors, the first value of the first operating parameter, and the second value of the first operating parameter describing a stop response compensation for the dispensing system as a function of the first operating parameter of the dispensing system.

6. The method of claim 1 wherein deriving the mathematical relationship for the start response compensation further comprises:

storing the start errors for the first plurality of workpieces and the second plurality of workpieces in a database as a function of the operating parameter.

7. The method of claim 1 wherein the material is an adhesive.

8. The method of claim 1 wherein the material is a hot melt adhesive.

9. The method of claim 1 wherein further comprising:

transporting a third plurality of the workpieces and a fourth plurality of the workpieces in the direction intersecting the detection point and the application point;

as the third plurality of the workpieces is transported past the application point, dispensing the amount of the material onto each of the third plurality of workpieces with a second operating parameter of the dispensing system set at a first value;

as the fourth plurality of the workpieces is transported past the application point, dispensing the amount of the material onto each of the second plurality of workpieces with the second operating parameter of the dispensing system set at a second value;

detecting an actual start position of the amount of the material on each of the third plurality of the workpieces and on each of fourth second plurality of the workpieces;

comparing the actual start position for the amount of material on each of the third plurality of the workpieces and each of the second plurality of the workpieces with the target start position for the amount of material to yield a plurality of start errors correlated with the second parameter; and deriving a mathematical relationship from the plurality of start errors correlated with the second parameter, the first value of the first operating parameter, and the second value of the first operating parameter describing the start response compensation time that describes the start error for the dispensing system as a function of the second operating parameter of the dispensing system.

10. The method of claim 9 wherein the second operating parameter is a temperature of the dispensed material or a pressure of the dispensed material.

11. The method of claim 1 further comprising:

correcting the start response compensation time to account for a delay introduced by a response time of a sensor detecting the actual start position of the amount of the material on each of the first plurality of workpieces and on each of the second plurality of workpieces.

12. The method of claim 1 wherein the start errors for the first plurality of workpieces are averaged to yield a first average value, the start errors for the first plurality of workpieces are averaged to yield a second average value, and the first and second average values for the start error are used to derive the mathematical relationship.

13. The method of claim 9 further comprising:

combining the mathematical relationship for the start response compensation time that describes the start error for the dispensing system as a function of the second operating parameter of the dispensing system with the mathematical relationship for the start response compensation time that describes the start error for the dispensing system as a function of the first operating parameter of the dispensing system.

14. The method of claim 1 further comprising:

transporting a third plurality of the workpieces in a direction intersecting the detection point and the application point; and as the third plurality of the workpieces are transported past the application point, dispensing the amount of the material onto each of the third plurality of workpieces.

* * * * *

UNITED STATES PATENT AND TRADEMARK OFFICE

CERTIFICATE OF CORRECTION

PATENT NO. : 8,334,023 B2
APPLICATION NO. : 12/256052
DATED : December 18, 2012
INVENTOR(S) : Martin Gaon et al.

It is certified that error appears in the above-identified patent and that said Letters Patent is hereby corrected as shown below:

In the Claims:

At column 15, claim number 9, line number 56, before “comprising”, delete “wherein further”.

At column 16, claim number 9, line number 13, after “fourth”, delete “second”.

Signed and Sealed this
Twelfth Day of March, 2013

Teresa Stanek Rea
*Acting Director of the United States Patent and Trademark Office*